US009302877B2

(12) United States Patent
Yasaka

(10) Patent No.: US 9,302,877 B2
(45) Date of Patent: Apr. 5, 2016

(54) PROCESSING DEVICE, AND IMAGE FORMING APPARATUS

(71) Applicant: FUJI XEROX CO., LTD., Tokyo (JP)

(72) Inventor: Yuichi Yasaka, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/223,280

(22) Filed: Mar. 24, 2014

(65) Prior Publication Data

US 2015/0001789 A1 Jan. 1, 2015

(30) Foreign Application Priority Data

Jul. 1, 2013 (JP) ..... 2013-138423

(51) Int. Cl.

| | |
|---|---|
| ***B65H 31/34*** | (2006.01) |
| ***B65H 31/36*** | (2006.01) |
| ***B65H 29/14*** | (2006.01) |
| ***B65H 31/30*** | (2006.01) |

(52) U.S. Cl.

CPC ..... *B65H 31/34* (2013.01); *B65H 29/145* (2013.01); *B65H 31/3027* (2013.01); *B65H 31/36* (2013.01); *B65H 2301/4212* (2013.01); *B65H 2301/4213* (2013.01); *B65H 2403/942* (2013.01); *B65H 2404/1114* (2013.01); *B65H 2404/144* (2013.01); *B65H 2404/152* (2013.01); *B65H 2801/27* (2013.01)

(58) Field of Classification Search

CPC ..... B65H 31/34; B65H 31/36; B65H 29/145
USPC ..... 271/233, 245, 246; 270/58.12, 58.27
See application file for complete search history.

(56) References Cited

U.S. PATENT DOCUMENTS

| | | | | |
|---|---|---|---|---|
| 7,248,829 | B2 * | 7/2007 | Kobayashi | 399/410 |
| 7,954,811 | B2 * | 6/2011 | Ishikawa et al. | 271/245 |
| 7,976,004 | B2 * | 7/2011 | Kimura | 270/58.11 |
| 8,123,209 | B2 * | 2/2012 | Kubota et al. | 270/58.07 |
| 8,141,863 | B2 * | 3/2012 | Nakamura et al. | 270/58.13 |
| 8,342,499 | B2 * | 1/2013 | Shiraishi et al. | 270/58.08 |
| 8,439,342 | B2 * | 5/2013 | Okamoto et al. | 270/58.11 |
| 8,770,570 | B2 * | 7/2014 | Soga | 270/58.12 |
| 8,814,157 | B2 * | 8/2014 | Gamo | 271/3.02 |
| 2010/0225042 | A1 | 9/2010 | Tanaka et al. | |

FOREIGN PATENT DOCUMENTS

| | | |
|---|---|---|
| JP | A-2007-308215 | 11/2007 |
| JP | A-2010-208747 | 9/2010 |

* cited by examiner

*Primary Examiner* — Jeremy R Severson
(74) *Attorney, Agent, or Firm* — Oliff PLC

(57) ABSTRACT

Provided is a processing device including a shifting member that superimposes recording media during transportation and that places an uppermost recording medium and a lower recording medium on the lower side of the uppermost recording medium in plural superimposed recording media, a butting member that transports the recording media placed on the stack table so that edge portions of the plural recording media superimposed, and a pressing member that is arranged above the stack table and that contacts with the lower recording medium among the plural recording media transported by the butting member to press the edge portion of the lower recording medium against the aligning member, and then contacts with the uppermost recording medium to press the edge portion of the uppermost recording medium against the aligning member.

2 Claims, 19 Drawing Sheets

PROCESSING DEVICE, AND IMAGE FORMING APPARATUS

CROSS-REFERENCE TO RELATED APPLICATIONS

This application is based on and claims priority under 35 USC 119 from Japanese Patent Application No. 2013-138423 filed Jul. 1, 2013.

BACKGROUND

Technical Field

The present invention relates to a processing device, and an image forming apparatus including the processing device.

SUMMARY

According to an aspect of the invention, there is provided a processing device including:

a shifting member that superimposes recording media during transportation and that places an uppermost recording medium and a lower recording medium on the lower side of the uppermost recording medium in plural superimposed recording media, on a stack table on which the recording media are stacked, in a state where the uppermost recording medium and the lower recording medium are shifted in a transport direction of the recording media;

a butting member that transports the recording media placed on the stack table so that edge portions of the plural recording media superimposed in a state where the uppermost recording medium and the lower recording medium are shifted to butt against an aligning member arranged on an upstream side in the transport direction of the recording media with respect to the stack table; and a pressing member that is arranged above the stack table and that contacts with the lower recording medium among the plural recording media transported by the butting member to press the edge portion of the lower recording medium against the aligning member, and then contacts with the uppermost recording medium to press the edge portion of the uppermost recording medium against the aligning member.

BRIEF DESCRIPTION OF THE DRAWINGS

Exemplary embodiments of the present invention will be described in detail based on the following figures, wherein.

DETAILED DESCRIPTION

An example of a processing device and an image forming apparatus according to the exemplary embodiment of the invention will be described according to FIGS. 1A to 11. In addition, in a plan view of the image forming apparatus, a direction of arrow X shown in the respective drawings corresponds to a right direction in the horizontal, direction, a direction of arrow −X corresponds to a left direction in the horizontal direction, a direction of arrow Y corresponds to an upward direction in the vertical direction, and a direction of arrow −Y corresponds to a downward direction in the vertical direction.

Figure 11:
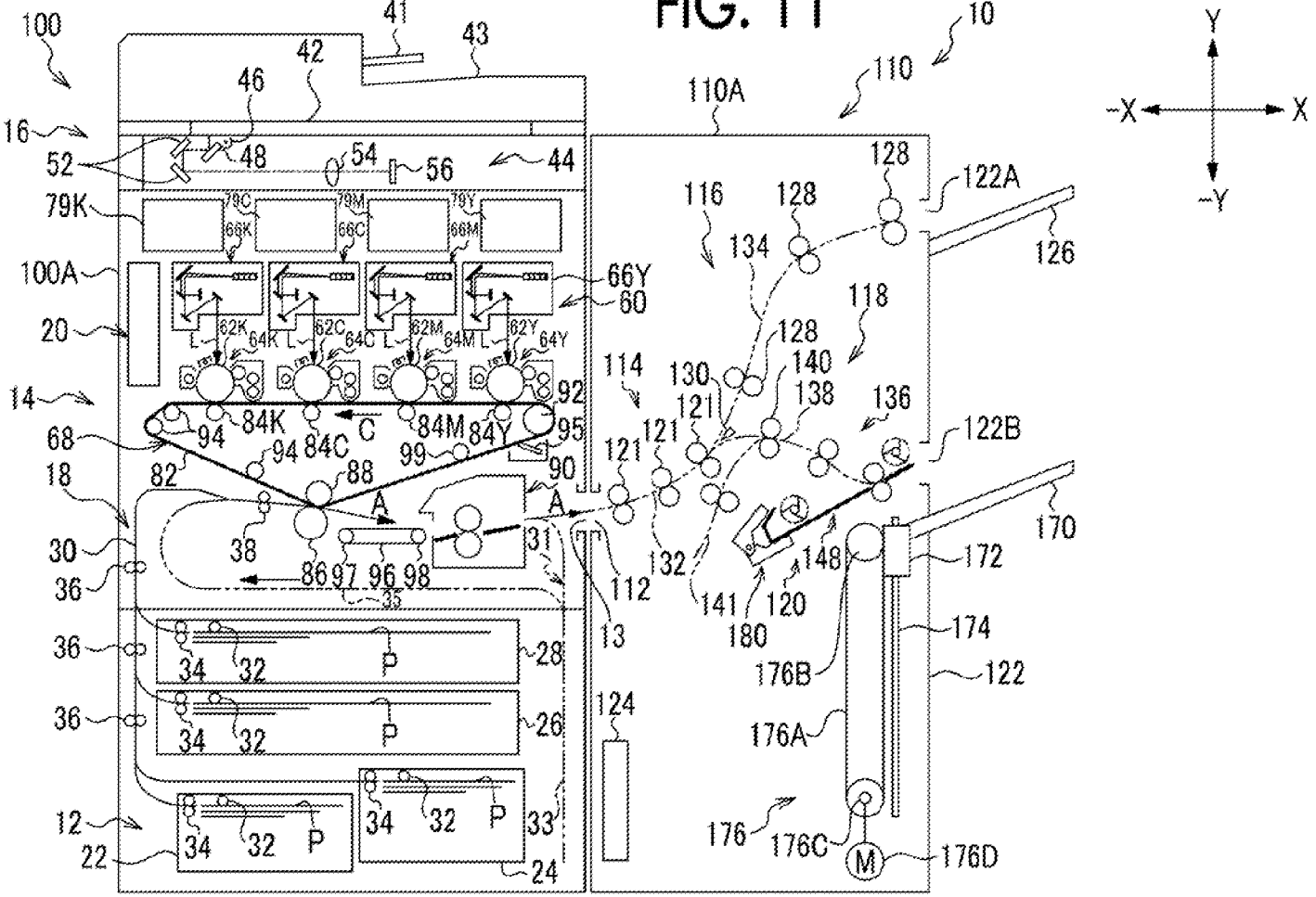
FIG. 11 is a schematic configuration diagram showing the image forming apparatus according to the exemplary embodiment of the invention.

An image forming apparatus 10, as shown in FIG. 11, includes an image forming main body 100 that forms an image on a sheet member P as a recording medium, and a post-processor 110 as an example of a processing device.

(Configuration of Image Forming Main Body)

As shown in FIG. 11, the image forming main body 100 is configured to include a sheet accommodating section 12 that accommodates the sheet members P, a main operation section 14 that is provided on the upper side of the sheet accommodating section 12 to perform image formation on the sheet member P supplied from the sheet accommodating section 12, an original document reading section 16 that is provided on the upper side of the main operation section 14 to read an original document (not shown), a transporting section 18 that transports the sheet member P to the respective sections, and a main control section 20 that is provided within the main operation section 14 to control the operation of the respective sections of the image forming main body 100, from the bottom toward the top in the vertical direction (Y direction).

Also, the image forming main body 100 includes an apparatus body 100A as a housing constituted by plural frame members.

[Sheet Accommodating Section]

The sheet accommodating section 12 includes a first accommodating section 22, a second accommodating section 24, a third accommodating section 26, and a fourth accommodating section 28 that may accommodate the sheet members P with different sizes. The first accommodating section 22, the second accommodating section 24, the third accommodating section 26, and the fourth accommodating section 28 include a feed roller 32 that feeds the accommodated sheet members P one by one, a transporting roller 34 that transports the fed sheet member P toward a transporting path 30 for the sheet member P that is provided within the image forming main body 100.

[Transporting Section]

The transporting section 18 includes plural transporting rollers 36 that are arranged on the downstream side of the transporting path 30 with respect to the transporting roller 34 to transport the sheet members P one by one. Moreover, a registration roller 38, which stops the sheet member P once and feeds the sheet member P to a secondary image transfer position (to be described below) at a predetermined timing to perform registration of image transfer, is arranged on the downstream side of the transporting rollers 36 in a direction in which the sheet member P is transported (hereinafter simply referred to as a "sheet transport direction").

An upstream portion of the transporting path 30 is made linear from an −X-direction side of the sheet accommodating section 12 to a lower portion of the main operation section 14 on a −X-direction side toward the direction of arrow Y in a plan view of the image forming main body 100. Additionally, a downstream side portion of the transporting path 30 extends from the lower portion of the main operation section 14 on the −X-direction side to an ejection port 13 provided at a lower portion of the main operation section 14 on a X-direction side.

Moreover, a double-sided transporting path 31 along which the sheet member P is transported and reversed is connected to the transporting path 30 in order to perform image formation on both sides of the sheet member P. In addition, the transport direction of the sheet member P when double-sided transport is not performed is shown by arrow A.

The double-sided transporting path 31 includes a sheet-reversing portion 33 that is provided linearly in the direction of arrow Y from lower portion of the main operation section 14 in the X-direction side to the X-direction side of the sheet accommodating section 12, and a transporting portion 35 that the trailing edge of the sheet member P transported to the sheet-reversing portion 33 enters and that transports the sheet member P to the illustrated −X direction side (shown by arrow B), in the plan view of the image forming main body 100. Also, a downstream end portion of the transporting portion 35 is connected to the portion of the transporting path 30 located further toward the upstream side than the registration roller 38 by a guide member (not shown). In addition, in FIG. 11, illustration of a switching member that performs switching between the transporting path 30 and the double-sided transporting path 31, and illustration of a switching member that performs switching between the sheet-reversing portion 33 and the transporting portion 35 are omitted.

[Original Document Reading Section]

The original document reading section 16 includes an original document placing table 41 capable of placing plural original documents (not shown), a platen glass 42 on which one sheet of original document is placed, an original document reader 44 that reads an original document placed on the platen glass 42, and an original document ejection portion 43 to which the read original document is ejected.

The original document reader 44 includes a light radiating portion 46 that irradiates the original document placed on the platen glass 42 with light, one full-rate mirror 48 and two half-rate mirrors 52 that reflect and turn back reflected light, which is irradiated by the light radiating portion 46 and reflected from the original document, in a direction parallel to the platen glass 42, a focusing lens 54 on which the reflected light turned back by the full-rate mirror 48 and the half-rate mirror 52 is incident, and a photoelectric transducer 56 that converts the reflected light focused by the focusing lens 54 into electrical signals.

The electrical signals converted by the photoelectric transducer 56 are subjected to image processing by an image processor (not shown) and are used for image formation. Additionally, the full-rate mirror 48 is adapted to move at a full rate along the platen glass 42, and the half-rate mirror 52 is adapted to move at a half rate along the platen glass 42.

[Main Operation Section]

The main operation section 14 includes an image forming portion 60 that forms a toner image on the sheet member P, and a fixing device 90 that fixes the toner image, which is formed on the sheet member P formed by the image forming portion 60, on the sheet member P with heat and pressure.

[Image Forming Portion]

The image forming portion 60 is configured to include image forming units 64K, 64C, 64M, and 64Y including image holding members 62K, 62C, 62M, and 62Y corresponding to respective toners of yellow (Y), magenta (M), cyan (C), and black (K), exposure units 66K, 66C, 66M, and 66Y that emit light beams L toward outer circumferential surfaces of the image holding members 62K, 62C, 62M, and 62Y to perform exposure, and a transfer unit 68 that transfers toner images formed by the image forming units 64K, 64C, 64M, and 64Y onto the sheet member P.

In addition, in the subsequent description, description will be made after any alphabetic characters of Y, M, C, and K are attached to the ends of figures when it is necessary to distinguish Y, M, C, and K, and description of Y, M, C, and K will be omitted when configurations are the same and it is not necessary to distinguish Y, M, C, and K.

[Exposure Unit (Image Forming Portion)]

The exposure unit 66 is configured to scan a light beam emitted from a light source (not shown) with a rotating polygon mirror (polygon mirror: with no symbol), reflect the light beam with plural optical, components including a reflecting mirror, and emit a light beam L corresponding to each color toner toward an image holding member 62. Additionally, the image holding member 62 is provided on the lower side (−Y-direction side) of the exposure unit 66.

[Image Forming Unit (Image Forming Portion)]

Figure 10:
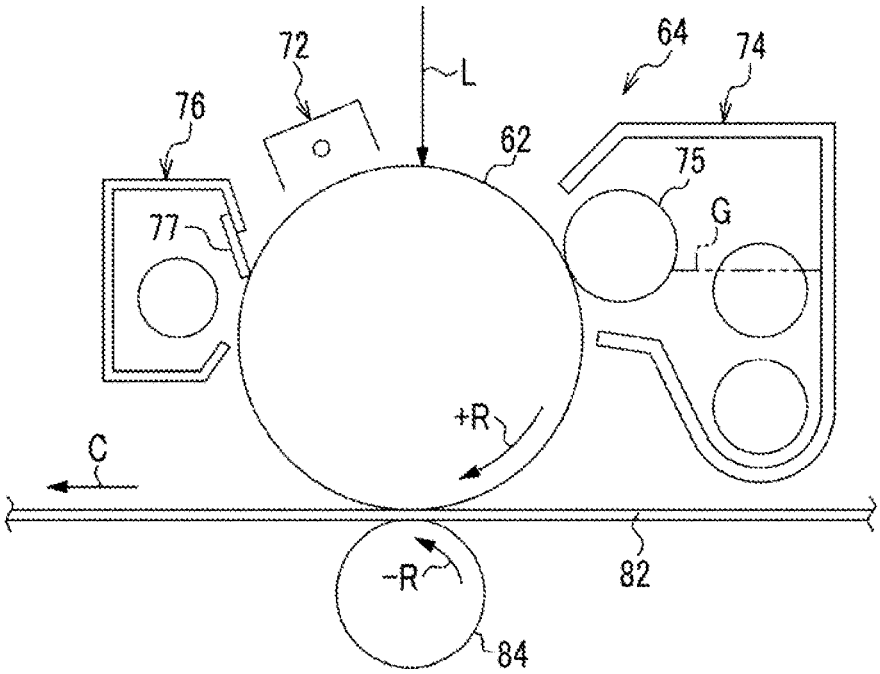
FIG. 10 is a configuration view showing an image forming unit provided in an image forming apparatus according to the exemplary embodiment of the invention.

As shown in FIG. 10, an image forming unit 64 is configured to include the columnar image holding member 62 that is made rotatable in a direction (the clockwise direction in the drawing) of arrow +R, and a charging unit 72, a developer unit 714, and a cleaning member 76 that face an outer circumferential surface of the image holding member 62 and are arranged in order from an upstream side to a downstream side in a rotational direction.

Also, the charging unit 72 and the developer unit 74 are arranged so that a light beam L is emitted at a position between the charging unit 72 and the developer unit 74 on the outer circumferential surface of the image holding member 62. Additionally, an intermediate image transfer belt 82 as an example of a transfer body contacts with the outer circumferential surface of the image holding member 62 at a position between the developer unit 74 and the cleaning member 76.

The image holding member 62 is rotatable in the direction of arrow +R by driving of a motor (not shown). Additionally, the charging unit 72 is constituted by, for example, a corotron type charging unit that applies a voltage to a wire and charges the outer circumferential surface of the image holding member 62 with the same polarity as toner by corona discharge. Here, a latent image (electrostatic latent image) is formed by a light beam L being emitted to the outer circumferential surface of the charged image holding member 62 on the basis of image data.

The developer unit 74 contains developer G in which carrier particles made of, for example, a magnetic body, and toner charged with negative polarity are mixed, and is provided with a cylindrical developing sleeve 75 that has a magnet roll (not shown) having plural magnetic poles in a circumferential direction provided therein. Also, the developer unit 74 forms a magnetic brush at a region that faces the image holding member 62 as the developing sleeve 75 rotates. Moreover, the developer unit 74 is adapted to visualize the latent image on the outer circumferential surface of the image holding member 62 with the toner to form a toner image (developer image) as a developing bias is applied to the developing sleeve 75 by a voltage application unit (not shown). In addition, the toner is supplied from each toner cartridge 79 (refer to FIG. 11) provided above the image forming portion 60 to each developer unit 74.

The cleaning member 76 includes a cleaning blade 77 that contacts with the outer circumferential surface of the image holding member 62, and the toner remaining on the outer circumferential surface of the image holding member 62 is scraped off and recovered by the cleaning blade 77. Additionally, the intermediate image transfer belt 82 to which a toner image developed by the developer unit 74 is primarily transferred is provided on the downstream side of the developer unit 74 in the rotational direction of the image holding member 62.

[Transfer Unit (Image Forming Portion)]

As shown in FIG. 11, the transfer unit 68 is configured to include the endless shape intermediate image transfer belt 82, a primary image transfer roller 84 as an example of a primary image transfer member that primarily transfers a toner image from the image holding member 62 onto the intermediate image transfer belt 82, and a secondary image transfer roller 86 and an auxiliary roller 88 as an example of a secondary image transfer member that secondarily transfer toner images sequentially superimposed on the intermediate image transfer belt 82 to the sheet member P.

Additionally, a driving roller 92 that is rotationally driven and plural transporting rollers 94 that are rotatably provided are arranged inside the intermediate image transfer belt 82. Also, the intermediate image transfer belt 82 is wound around primary image transfer rollers 84K, 84C, 84M, and 84Y, the driving roller 92, the transporting rollers 94, and the auxiliary roller 88. Accordingly, the intermediate image transfer belt 82 circularly moves in a direction (counterclockwise direction in the drawing) of arrow C when the driving roller 92 rotates counterclockwise.

The primary image transfer roller 84 has a configuration in which an elastic layer (not shown) is formed around a columnar shaft made of, for example, metal, such as stainless steel, and is rotatable as both end portions of the shaft are supported by bearings. Additionally, the primary image transfer roller 84 is adapted such that a voltage (positive voltage) with an opposite polarity to the polarity of toner is applied to the shaft from a power source (not shown).

The secondary image transfer roller 86, as an example, has the same configuration as the primary image transfer roller 84, is arranged on the downstream side of the registration roller 38 in the transporting path 30, and is rotatably provided. Additionally, the secondary image transfer roller 86 contacts with the outer circumferential surface of the intermediate image transfer belt 82 at a secondary image transfer position so as to nip the intermediate image transfer belt 82 with the auxiliary roller 88.

Also, the secondary image transfer roller 86 is grounded. Additionally, the auxiliary roller 88 forms a counter electrode of the secondary image transfer roller 86, and has a secondary image transfer voltage applied thereto via a metallic power feed roller (not shown) arranged to contact with an outer circumferential surface of the auxiliary roller 88. Here, as the secondary image transfer voltage (negative voltage) is applied to the auxiliary roller 88 and a potential difference is caused between the auxiliary roller 88 and the secondary image transfer roller 86, a toner image on the intermediate image transfer belt 82 is secondarily transferred onto the sheet member P transported to a contact portion between the secondary image transfer roller 86 and the intermediate image transfer belt 82.

A transporting belt 96 that transports the sheet member P, to which secondary image transfer of a toner image is ended, to the fixing device 90 is provided on the downstream side of the secondary image transfer roller 86 in a movement direction of the sheet member P. The transporting belt 96 is wound around a support roller 97 and a driving roller 98 and is adapted to circularly move so as to transport the sheet member P to the fixing device 90.

(Operation of Image Forming Main Body)

Next, the operation of the image forming main body 100 will be described.

When an image is formed on the sheet member P, as shown in FIG. 10, the respective image holding members 62 are charged by the charging units 72, are exposed by light beams L emitted from respective exposure units 66 according to image data, and electrostatic latent images are formed on the image holding members 62.

Subsequently, the electrostatic latent images formed on the outer circumferential surfaces of the respective image holding members 62 are developed as toner images in respective colors of yellow (Y), magenta (M), cyan (C), and black (K), respectively, by the developer units 74.

Subsequently, as shown in FIG. 11, the respective toner images formed on the surfaces of the respective image holding members 62 are sequentially multiple-transferred onto the intermediate image transfer belt 82 by the respective primary transfer rollers 84 at primary image transfer positions. Then, the toner images multiple-transferred on the intermediate image transfer belt 82 are secondarily transferred onto the sheet member P, which is transported along the transporting path 30, by the secondary image transfer roller 86 and the auxiliary roller 88 at the secondary image transfer position.

Subsequently, the sheet member P to which the toner images are transferred is transported toward the fixing device 90 by the transporting belt 96. Then, in the fixing device 90, the toner images on the sheet member P are fixed by being heated and pressurized. The sheet member P on which the toner images are fixed is ejected from the ejection port 13 and is passed to the post-processor 110 to be described below. A series of image forming steps are performed in this way.

In addition, when toner images are formed on a non-image surface on which no image is formed (in the case of double-sided image formation), image fixation is performed on a front side by the fixing device 90, and then, the sheet member P is fed to the double-sided transporting path 31 and image formation and fixation is performed on a rear side.

(Configuration of Main Portions)

The post-processor 110, as shown in FIG. 11, includes a housing 110A that is arranged next to the image forming main body 100, and a receiving port 112 that receives the sheet member P ejected from the ejection port 13 is formed at a position, which faces the ejection port 13 of the apparatus body 100A, in the housing 110A.

Moreover, a common unit 114 through which all sheet members P pass, an ejection unit 116 that receives the sheet member P from the common unit 114 and ejects the sheet members P one by one to the outside of the housing 110A, and a stack unit 118 that receives the sheet member P from the common unit 114 and has plural sheet members P superimposed thereon while being transported are provided inside the housing 110A. Moreover, the post-processor 110 includes a processing unit 120 that processes the sheet members P stacked by the stack unit 118 to eject the sheet members P to the outside of the housing 110A, and a controller 124 that controls the respective units arranged in the housing 110A.

In addition, the control of the respective sections by the controller 124 will be described in the operation of the post-processor to be described below.

[Common Unit]

The common unit 114 includes a common path 132 that extends from the receiving port 112, and plural transporting rollers 121 (three pairs in the present exemplary embodiment) that transports the sheet member P received from the receiving port 112 along the common path 132. Additionally, the common unit 114 includes a motor (not shown) that rotates the transporting rollers 121.

Moreover, in the common path 132, a detection sensor 133 (refer to FIGS. 4A and 4B) that detects the sheet member P that is transported is arranged on the downstream side in the sheet transport direction.

[Ejection Unit]

The ejection unit 116 is coupled to a termination end of the common path 132, and includes an ejection path 134 for ejecting the sheet members P one by one to an ejection table 126 arranged on an upper side, in the vertical direction, of a side wall 122 opposite to the side of the housing 110A that faces the image forming main body 100.

Specifically, the side wall 122 of the housing 110A is formed with an ejection port 122A for ejecting the sheet member P to the ejection table 126, and a portion from the termination end of the common path 132 to the ejection port 122A serves as the ejection path 134.

Moreover, the ejection unit 116 includes plural transporting rollers 128 (three pairs in the present exemplary embodiment) that transports the sheet member P along the ejection path 134, and a motor (not shown) that rotates the transporting rollers 128.

Additionally, a distribution member 130 that distributes the sheet member P to the ejection path 134 or a transporting path 138 to be described below is arranged at the termination end of the common path 132, and the controller 124 controls the distribution member 130 to thereby determine the transport direction of the sheet member P (refer to FIG. 9).

[Stack Unit]

The stack unit 118 is arranged on the lower side in the vertical direction with respect to the ejection unit 116. Also, the stack unit 118 includes a buffer portion 136 (buffer pass) as an example of a shifting member that superimposes the sheet members P thereon during transportation and that shifts an uppermost sheet member P1 (uppermost recording medium) and a lower sheet member P2 (lower recording medium) on the lower side of the uppermost sheet member P1 in the plural superimposed sheet members P, in the sheet transport direction.

Figure 4A:
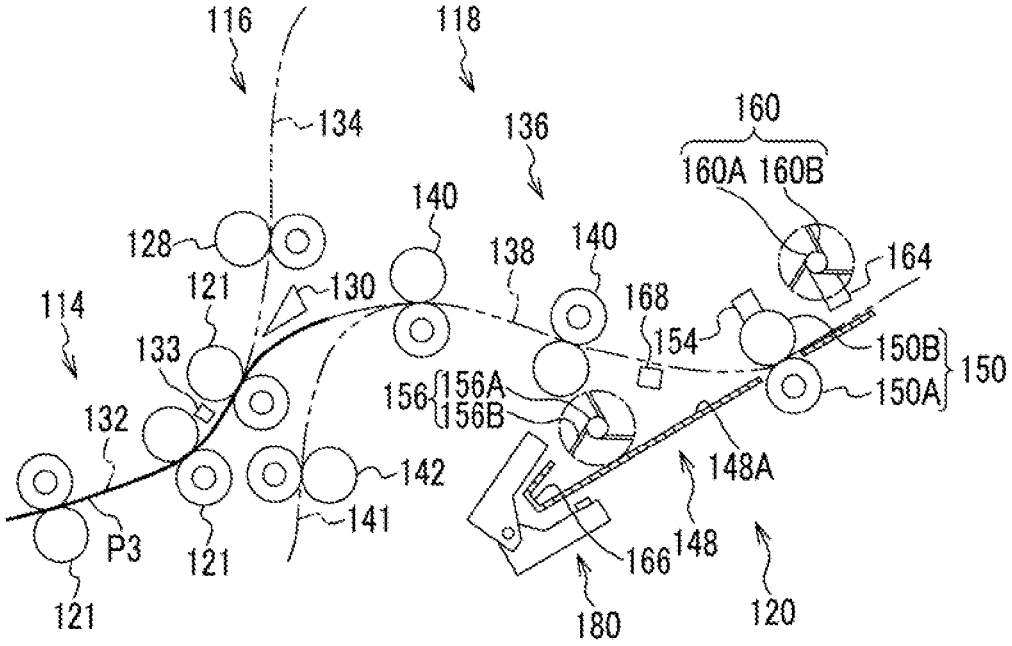
FIGS. 4A and 4B are side views showing a transporting path, a retreat path, the stack table, or the like provided in the post-processor according to the exemplary embodiment of the invention.
Figure 4B:
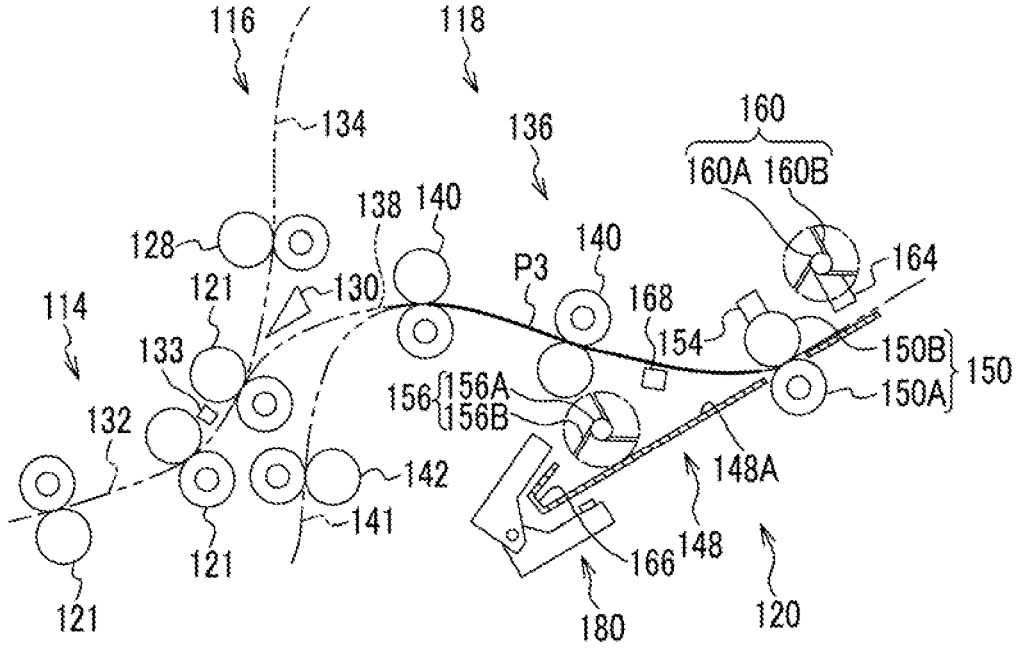

The buffer portion 136, as shown in FIGS. 4A and 4B, includes the transporting path 138 that extends from the termination end of the common path 132 to the downstream side in the sheet transport direction, and a retreat path 141 to which the sheet member P is retreated from the transporting path 138.

Moreover, the stack unit 118 includes a transporting roller 140 as an example of plural transporting members (two pairs in the present exemplary embodiment) that transports the sheet member P along the transporting path 138, and a transporting roller 142 as an example of a transporting member that transports the sheet member P along the retreat path 141. Additionally, the stack unit 118 includes a motor 144 that rotates the transporting roller 140, and a motor 146 that rotates the transporting roller 142 (refer to FIG. 9). Also, the sheet member P is transported to the downstream side in the sheet transport direction as the transporting roller 140 and the transporting roller 142 rotate normally, and the sheet member P is transported to the upstream side in the sheet transport direction as the transporting roller 140 and the transporting roller 142 rotates reversely.

Moreover, in the transporting path 138, a detection sensor 168 that detects the sheet member P that is transported is arranged on the downstream side in the sheet transport direction.

In addition, a configuration (operation) in which plural sheet members P are superimposed and transported by the buffer portion 136, and a shift amount by which the uppermost sheet member P1 and the lower sheet member P2 are shifted in the sheet transport direction will be described together with the operation of the post-processor to be described below.

[Processing Unit]

The processing unit 120 is adapted to process the sheet members P superimposed by the stack unit 118 and ejects the sheet members P to the outside of the housing 110A through an ejection port 122B (refer to FIG. 11) formed in the side wall 122.

Also, the processing unit 120, as shown in FIGS. 4A and 4B, includes a butting roller 150 as an example of a butting member that normally rotates and receives plural sheet members P superimposed and transported by the stack unit 118, and a plate-shaped stack table 148 (so-called compiling tray) on which the plural sheet members P received by the butting roller 150 are placed.

Moreover, the processing unit 120 includes an aligning portion 166 as an example of an aligning member that butts against edge portions (edge portions on the upstream side in the sheet transport direction) of sheet members P placed on the stack table 148 and aligns the edge portions of the plural sheet members P, a first paddle 156 as an example of a pressing member that presses the edge portions of the sheet members P against the aligning portion 166, and a second paddle 160 that presses the edge portions of the sheet members P against the aligning portion 166 together with the first paddle 156.

Additionally, the processing unit 120 includes a stapling mechanism 180 that staples and binds plural sheet members P aligned on the stack table 148.

[Butting Roller]

The butting roller 150 includes a driving roller 150A that has a rotative force transmitted thereto from a motor 152 as a driving source (refer to FIG. 9) and is rotationally driven, and a driven roller 150B to which the rotative force of the driving roller 150A is transmitted via a sheet member P nipped between the driven roller 150B and the driving roller 150A. Also, the sheet member P is transported to the downstream side in the sheet transport direction as the driving roller 150A (butting roller 150) rotates normally, and the sheet member P is transported to the upstream side in the sheet transport direction as the driving roller (butting roller) rotates reversely.

The driven roller 150B is arranged so as to contact with the uppermost sheet member P1 among the sheet members P placed on the stack table 148, and the driving roller 150A is arranged so as to contact with a lowermost sheet member P3 (lowermost recording medium) in the plural sheet members P.

Additionally, roller vertically-moving mechanisms 154, which support the driven roller 150B so as to be vertically movable, are arranged at both ends of the driven roller 150B in the longitudinal direction (only one is shown in respective drawings). Also, as the controller 124 controls the roller vertically-moving mechanisms 154, the driven roller 150B moves to a contact position (refer to FIG. 4A) where the driven roller is capable of contacting with (capable of nipping) the uppermost sheet member P1, and a spaced position (refer to FIG. 2A) where the driven roller is spaced apart from the uppermost sheet member P1.

[Aligning Portion]

The aligning portion 166 is arranged on the upstream side in the sheet transport direction with respect to the stack table 148.

Specifically, the aligning portion 166, as viewed from the axial direction of the butting roller 150, is formed by folding an end side of the stack table 148 in a direction orthogonal to a stacking surface 148A of the stack table 148.

Also, the butting roller 150 that rotates reversely is adapted to transport the sheet members P superimposed and placed on the stack table 148 so that edge portions of the plural sheet members P butt against the aligning portion 166.

[First Paddle]

The first paddle 156 is arranged between the aligning portion 166 and the butting roller 150 on the upper side of the stacking surface 148A.

The first paddle 156 includes a columnar shaft portion 156A to which a rotative force is transmitted from a motor 158 (refer to FIG. 9) as a driving source, and a blade portion 156B that has a base end portion fixed to the shaft portion 156A and that extends in a tangential direction of the shaft portion 156A, as viewed from the axial direction of the shaft portion 156A. Specifically, three blade portions 156B, each of which is molded from, for example, rubber members, are arranged at regular intervals in the circumferential direction of the shaft portion 156A.

By virtue of this configuration, the blade portion 156B of the first paddle 156 that is rotating is adapted to contact with the sheet member P and presses an edge portion of the contacting sheet member P against the aligning portion 166.

[Second Paddle]

The second paddle 160 is arranged on the opposite side of the first paddle 156 across the butting roller 150.

The second paddle 160 includes a columnar shaft portion 160A to which a rotative force is transmitted from a motor 162 (refer to FIG. 9) as a driving source, and a blade portion 160B that has a base end portion fixed to the shaft portion 160A and that extends in a tangential direction of the shaft portion 160A, as viewed from the axial, direction of the shaft portion 160A. Also, similar to the first paddle 156, three blade portions 160B, each of which is molded from, for example, rubber members, are arranged at regular intervals in the circumferential direction of the shaft portion 160A.

Additionally, paddle vertically-moving mechanisms 164, which support the second paddle 160 so as to be vertically movable and vertically move the second paddle, are arranged at both ends of the second paddle 160 in the longitudinal direction (only one is shown in respective drawings).

Figure 2A:
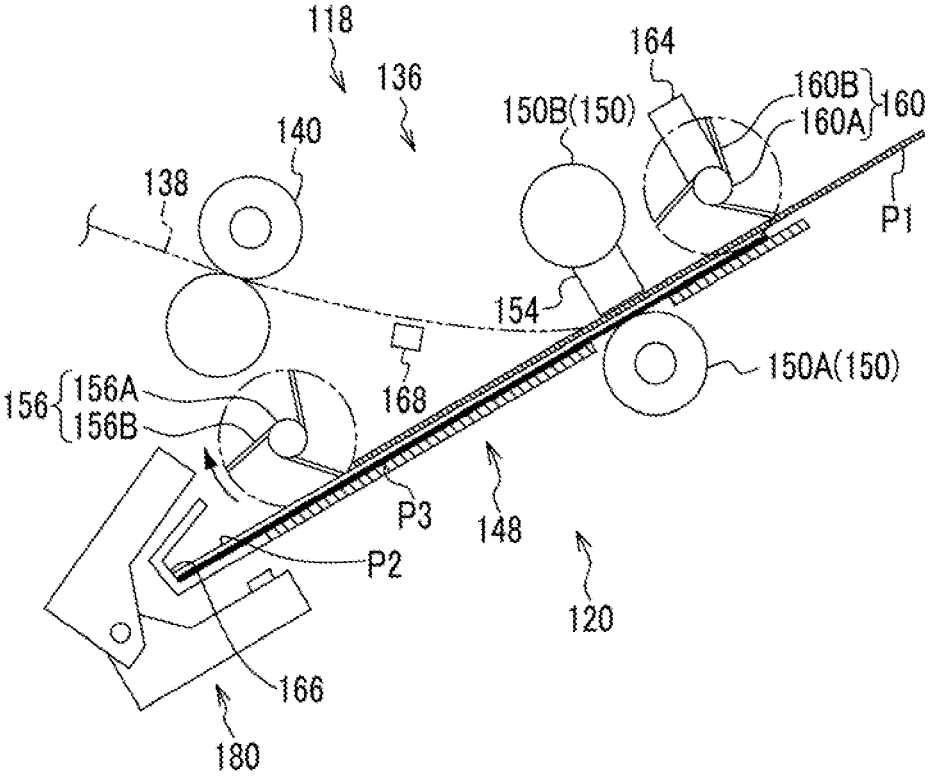
FIGS. 2A and 2B are side views showing the stack table or the like provided in the post-processor according to the exemplary embodiment of the invention.
Figure 3A:
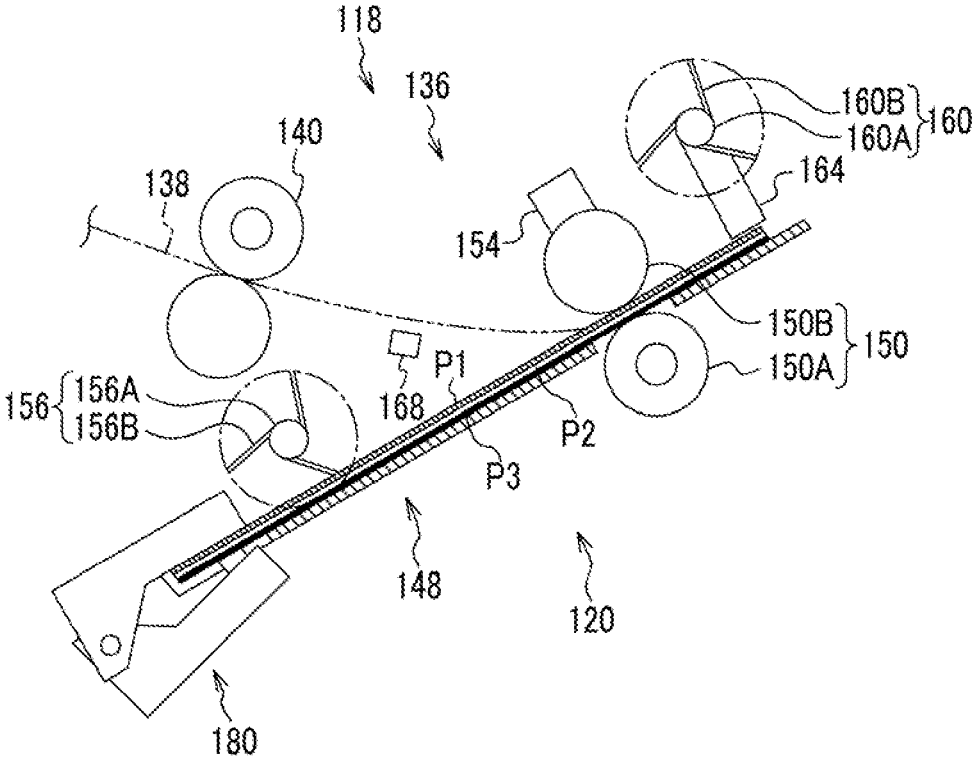
FIGS. 3A and 3B are side views showing the stack table or the like provided in the post-processor according to the exemplary embodiment of the invention.

Also, as the controller 124 controls the paddle vertically-moving mechanisms 164, the second paddle 160 moves to a contact position (refer to FIG. 2A) where the second paddle contacts with the uppermost sheet member P1, and a spaced position where the second paddle is spaced apart from the uppermost sheet member P1 (refer to FIG. 3A).

Additionally, as shown in FIG. 2A, the blade portion 160B of the second paddle 160, which is arranged at the contact position and rotates in contact with the sheet member P, is adapted to press an edge portion of a contacting sheet member P against the aligning portion 166.

[Others]

An ejection table 170 on which the sheet members P, which are processed by the processing unit 120 and ejected to the outside of the housing 110A through the ejection port 122B, are stacked, as shown in FIG. 11, is arranged on the lower side of the ejection table 126.

Moreover, a base end portion of the ejection table 170 is fixed to a supporting member 172 that is supported on a guide rail 174 extending in the vertical direction so as to be vertically movable.

Additionally, a table vertically-moving mechanism 176 that vertically moves the ejection table 170 is included, and the table vertically-moving mechanism 176 includes rollers 176B and 176C that are arranged apart from each other in the vertical direction, a belt 176A that is wound around the rollers 176B and 176C, and a motor 176D that rotates the roller 176C. Also, the aforementioned supporting member 172 is fixed to an outer circumferential surface of the endless shape belt 176A provided in the table vertically-moving mechanism 176.

Figure 9:
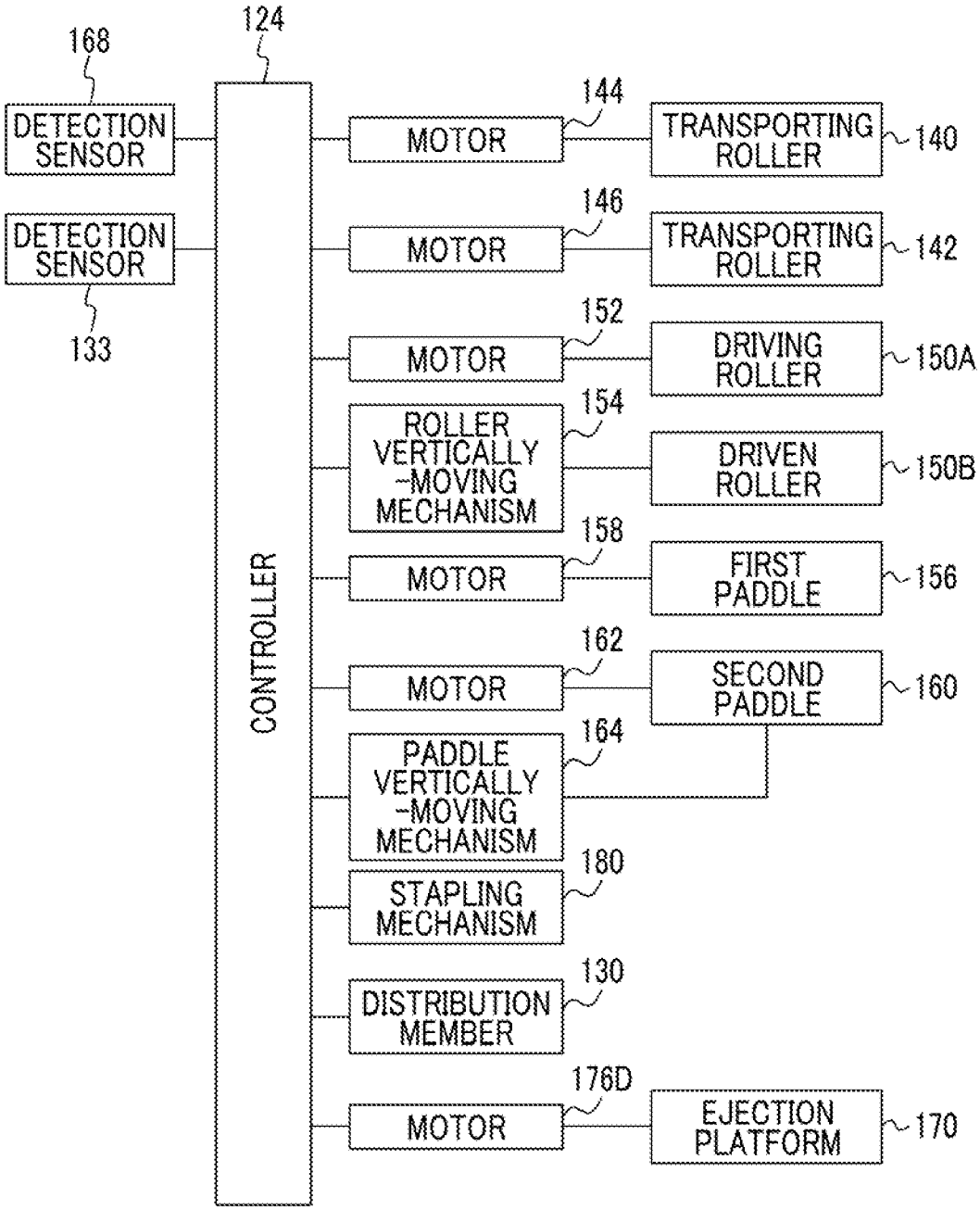
FIG. 9 is a block diagram showing the outline of a control system of a controller provided in the post-processor according to the exemplary embodiment of the invention.

In this configuration, as the controller 124 controls the motor 176D to circulate the belt 176A, the ejection table 170 moves up and down (refer to FIG. 9).

(Operation of Post-Processor)

Next, the operation of the post-processor 110 will be described regarding a case where three sheet members P are stapled and bound (stapling) and are ejected to the ejection table 170 as an example. In addition, when no sheet member P is transported into the housing 110A, the driven roller 150B is arranged at the contact position, and the second paddle 160 is arranged at the spaced position.

First, as shown in FIGS. 4A and 4B, a first sheet member P (hereinafter referred to as the "lowermost sheet member P3") is transported to the downstream side in the sheet transport direction along the common path 132 and is guided to the transporting path 138 by the distribution member 130.

The lowermost sheet member P3 guided to the transporting path 138 is transported to the downstream side in the sheet transport direction by the transporting roller 140 that rotates in a normal direction.

When the lowermost sheet member P3 that is transported is detected by the detection sensor 168, the controller 124 controls the motor 144 to rotate the transporting roller 140 in a reverse direction.

Figure 5A:
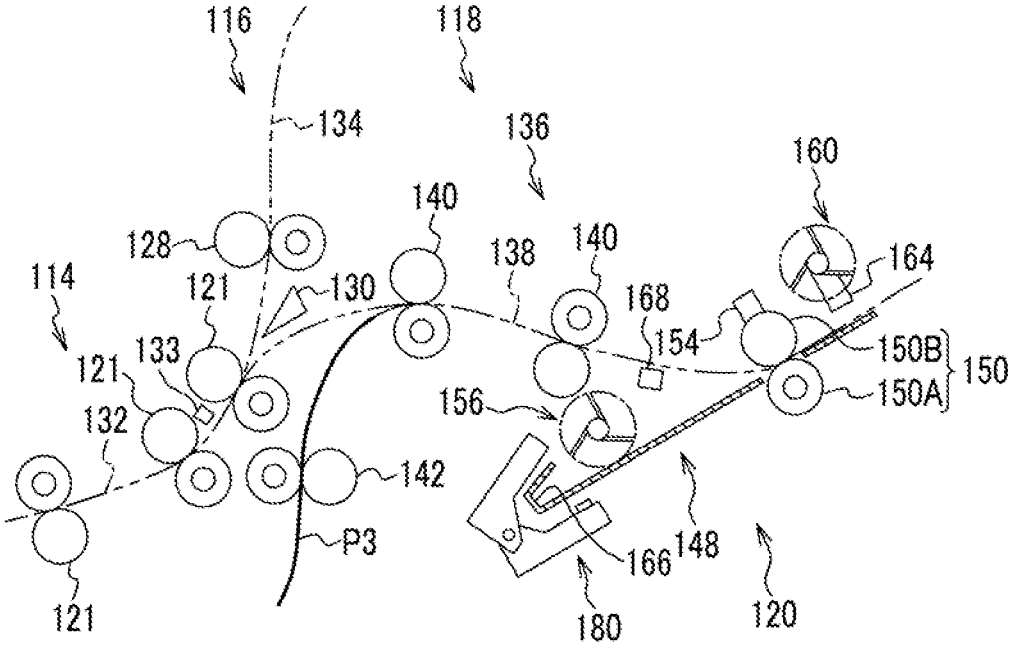
FIGS. 5A and 5B are side views showing the transporting path, the retreat path, the stack table, or the like provided in the post-processor according to the exemplary embodiment of the invention.

The transporting roller 140 that rotates in the reverse direction, as shown in FIG. 4B and FIG. 5A, transports the lowermost sheet member P3 toward the retreat path 141, and the lowermost sheet member P3 is guided to the guide member (not shown) and is pulled into the retreat path 141 by the transporting roller 142 that is arranged at the retreat path 141 and rotated in the reverse direction.

When the lowermost sheet member P3 is spaced apart from the transporting roller 140 and enters the retreat path 141, the controller 124 controls the motor 146 to stop the rotation of the transporting roller 142. Moreover, the controller 124 controls the motor 144 to rotate the transporting roller 140 in the normal direction (refer to FIG. 9). In this state, the lowermost sheet member P3 retreats to the retreat path 141.

Figure 5B:
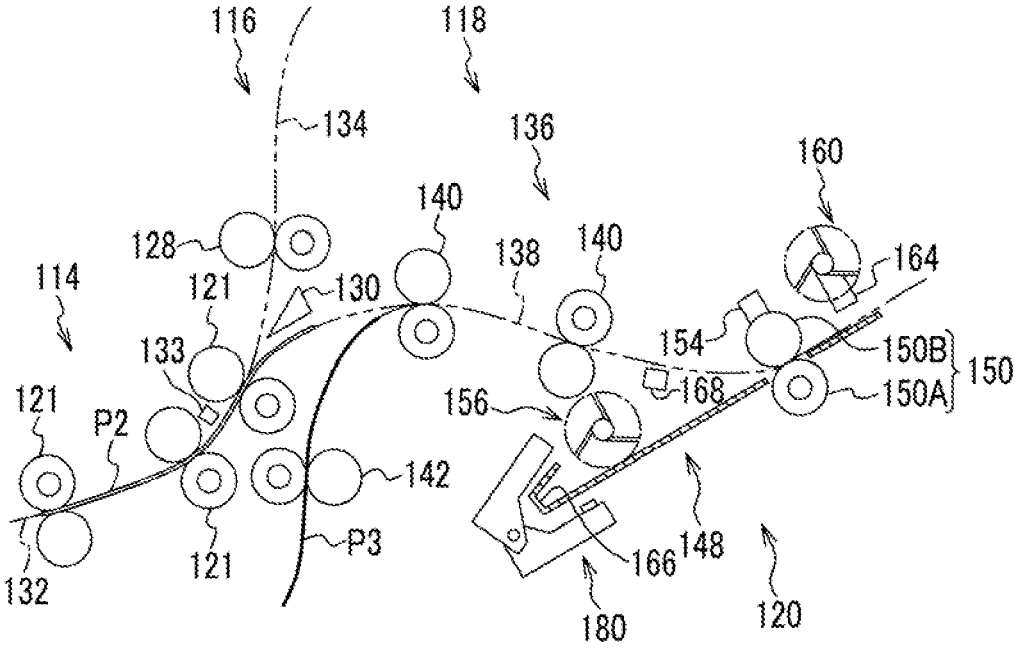
Figure 6A:
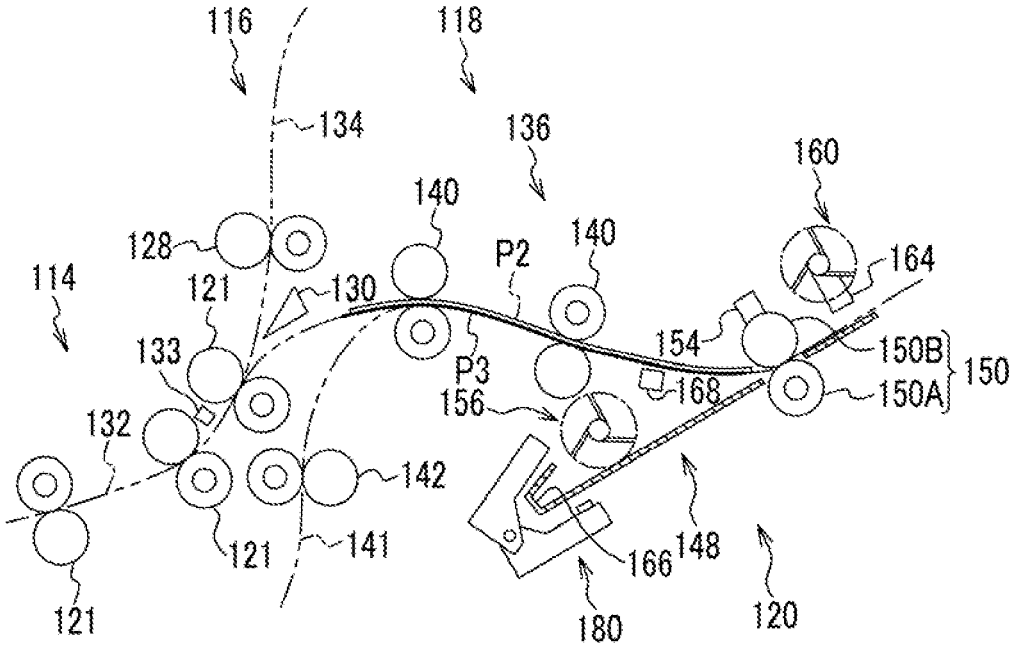
FIGS. 6A and 6B are side views showing the transporting path, the retreat path, the stack table, or the like provided in the post-processor according to the exemplary embodiment of the invention.

Next, as shown in FIG. 5B and FIG. 6A, a second sheet member P (hereinafter referred to as the "lower sheet member P2") is transported to the downstream side in the sheet transport direction along the common path 132, and the lower sheet member P2 is detected by the detection sensor 133, and is guided to the transporting path 138 by the distribution member 130. The lower sheet member P2 guided to the transporting path 138 is transported to the downstream side in the sheet transport direction by the transporting roller 140 that rotates in the normal direction.

On the other hand, when the lower sheet member P2 is detected by the detection sensor 133, the controller 124 controls the motor 146 to rotate the transporting roller 142 in the normal direction (refer to FIG. 9). The transporting roller 142 that rotates in the normal direction transports the lowermost sheet member P3 from the retreat path 141 to the transporting path 138.

Accordingly as shown in FIG. 5B and FIG. 6A, the lower sheet member P2 is superimposed on the lowermost sheet member P3 on the transporting path 138 so that the leading edge of the lower sheet member P2 protrudes with respect to the leading edge of the lowermost sheet member P3. Then, when the lowermost sheet member P3 that is superimposed and transported is detected by the detection sensor 168, the controller 124 controls the motor 144 to rotate the transporting roller 140 in the reverse direction. Moreover, the controller 124 controls the motor 146 to rotate the transporting roller 142 in the reverse direction.

Figure 6B:
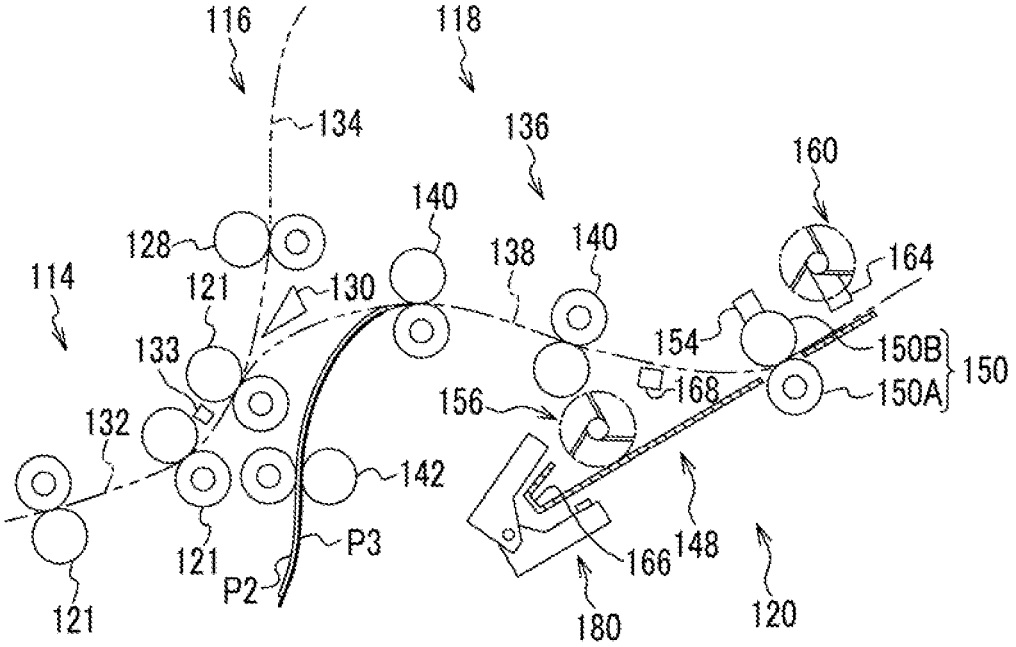

The transporting roller 140 that rotates in the reverse direction, as shown in FIG. 6A and FIG. 6B, transports the lower sheet member P2 and the lowermost sheet member P3 toward the retreat path 141, and the lower sheet member P2 and the lowermost sheet member P3 are pulled into the retreat path 141 by the transporting roller 142 that is arranged at the retreat path 141 and rotates in the reverse direction.

When the lower sheet member P2 is spaced apart from the transporting roller 140 and enters the retreat path 141, the controller 124 controls the motor 146 to stop the rotation of the transporting roller 142. Moreover, the controller 124 controls the motor 144 to rotate the transporting roller 140 in the normal direction (refer to FIG. 9). In this state, the lower sheet member P2 and the lowermost sheet member P3 retreats to the retreat path 141.

Figure 7A:
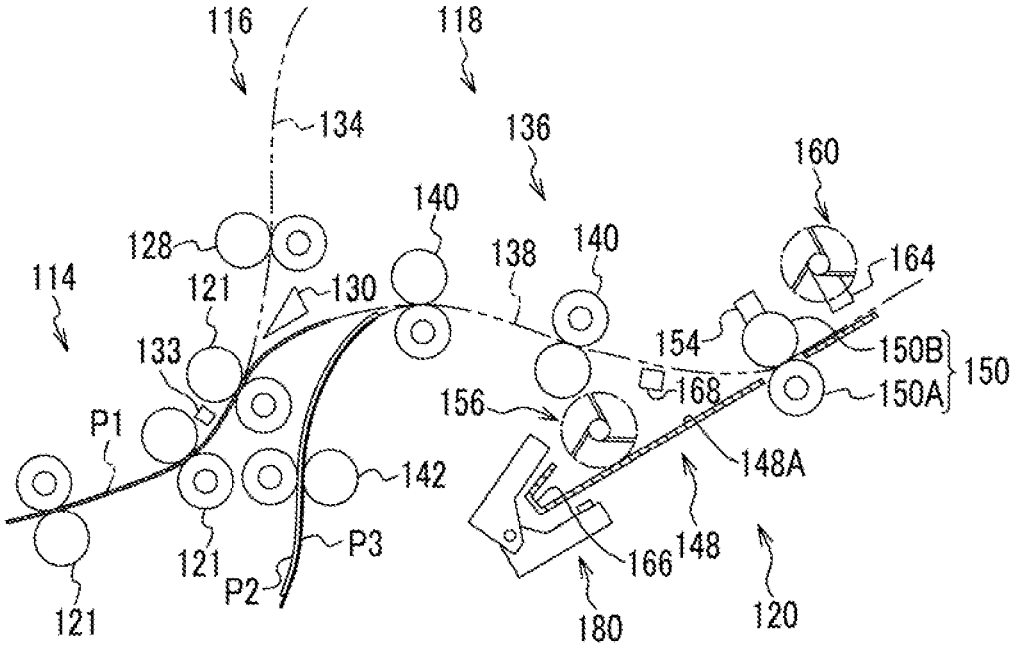
FIGS. 7A and 7B are side views showing the transporting path, the retreat path, the stack table, or the like provided in the post-processor according to the exemplary embodiment of the invention.
Figure 7B:
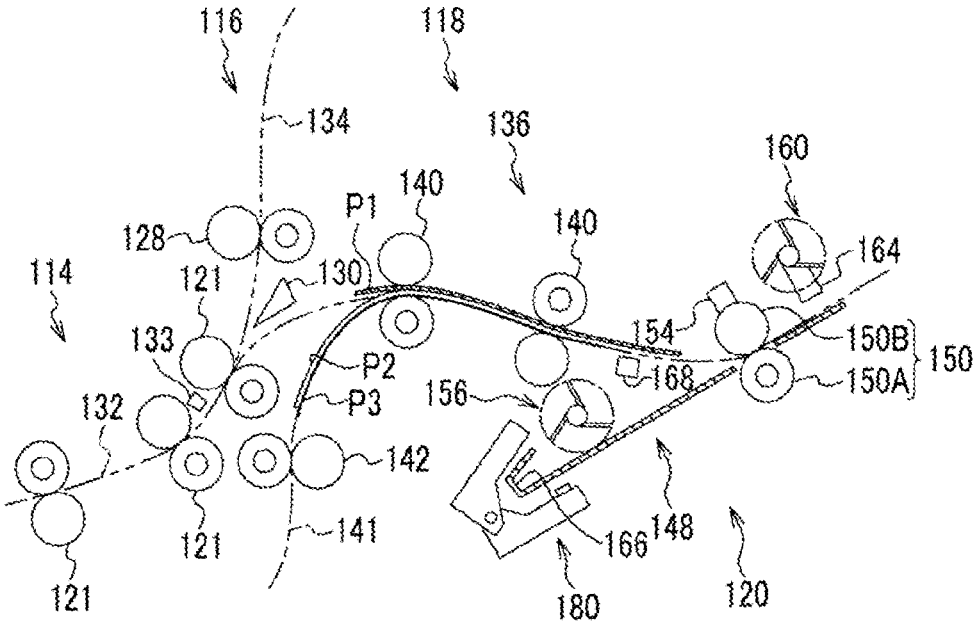

Next, as shown in FIG. 7A and FIG. 7B, a third sheet member P (hereinafter referred to as the "uppermost sheet member P1") is transported to the downstream side in the sheet transport direction along the common path 132, and the uppermost sheet member P1 is detected by the detection sensor 133, and is guided to the transporting path 138 by the distribution member 130. The uppermost sheet member P1 guided to the transporting path 138 is transported to the downstream side in the sheet transport direction by the transporting roller 140 that rotates in the normal direction.

On the other hand, when the uppermost sheet member P1 is detected by the detection sensor 133, the controller 124 controls the motor 146 to rotate the transporting roller 142 in the normal direction (refer to FIG. 9). The transporting roller 142 that rotates in the normal direction transports the lower sheet member P2 and the lowermost sheet member P3 from the retreat path 141 toward the transporting path 138.

Here, the controller 124 shifts and superimposes the lower sheet member P2 and the uppermost sheet member P1 so that the first paddle 156 presses the lower sheet member P2 against the aligning portion 166, and then contact with the uppermost sheet member P1 transported by the second paddle 160 to press the uppermost sheet member P1 against the aligning portion 166. That is, the controller 124 controls the timing at which the uppermost sheet member P1 is superimposed on the lower sheet member P2 by the buffer portion 136 so that the lower sheet member P2 and the uppermost sheet member P1 are shifted and superimposed in this way.

Figure 8A:
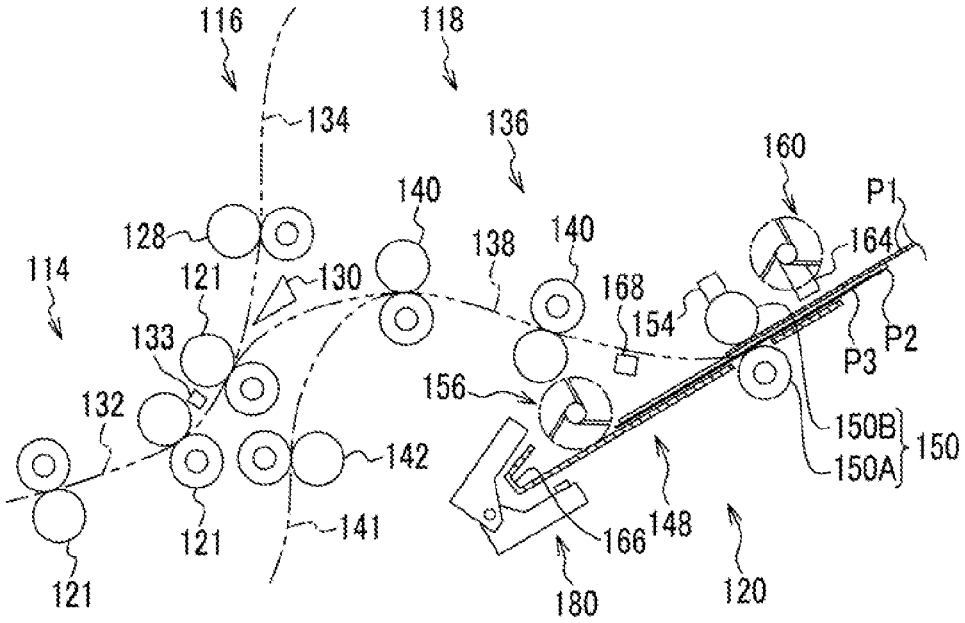
FIGS. 8A and 8B are side views showing the transporting path, the retreat path, the stack table, or the like provided in the post-processor according to the exemplary embodiment of the invention.

Then, the three sheet members P that are superimposed and transported, as shown in FIG. 7B and FIG. 8A, are transported to the butting roller 150 that rotates in the normal direction and are placed on the stack table 148.

Figure 8B:
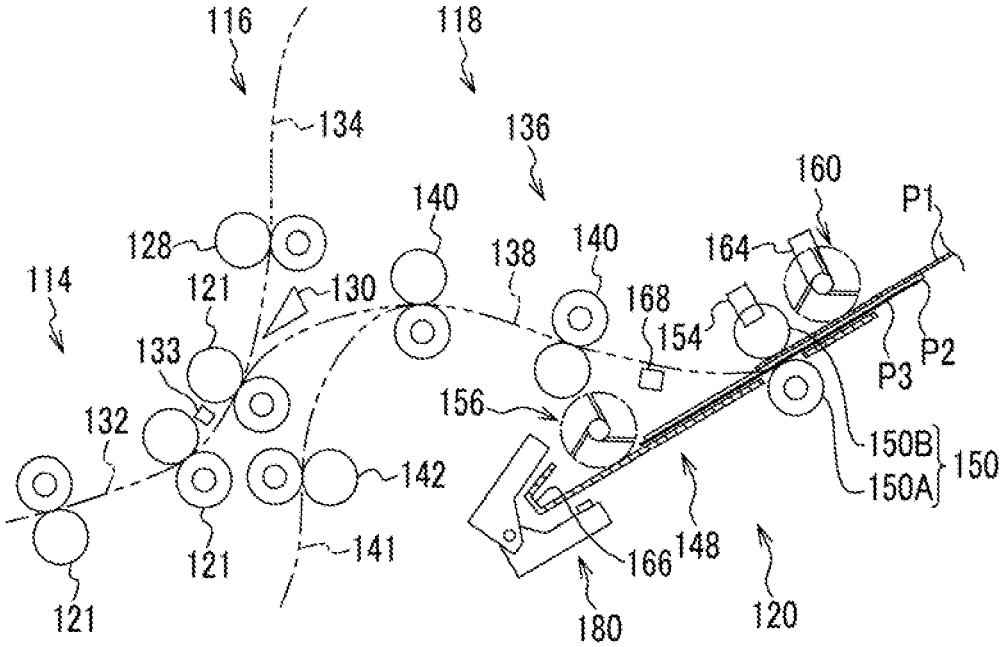

When the three superimposed and transported sheet members P are placed on the stack table 148, the controller 124 controls the paddle vertically-moving mechanism to move the second paddle 160 from the spaced position to the contact position (refer to FIG. 8B). Moreover, the controller 124 controls the motor 162 to rotate the second paddle, and controls the motor 152 to rotate the butting roller 150 in the reverse direction (refer to FIG. 9).

Figure 1A:
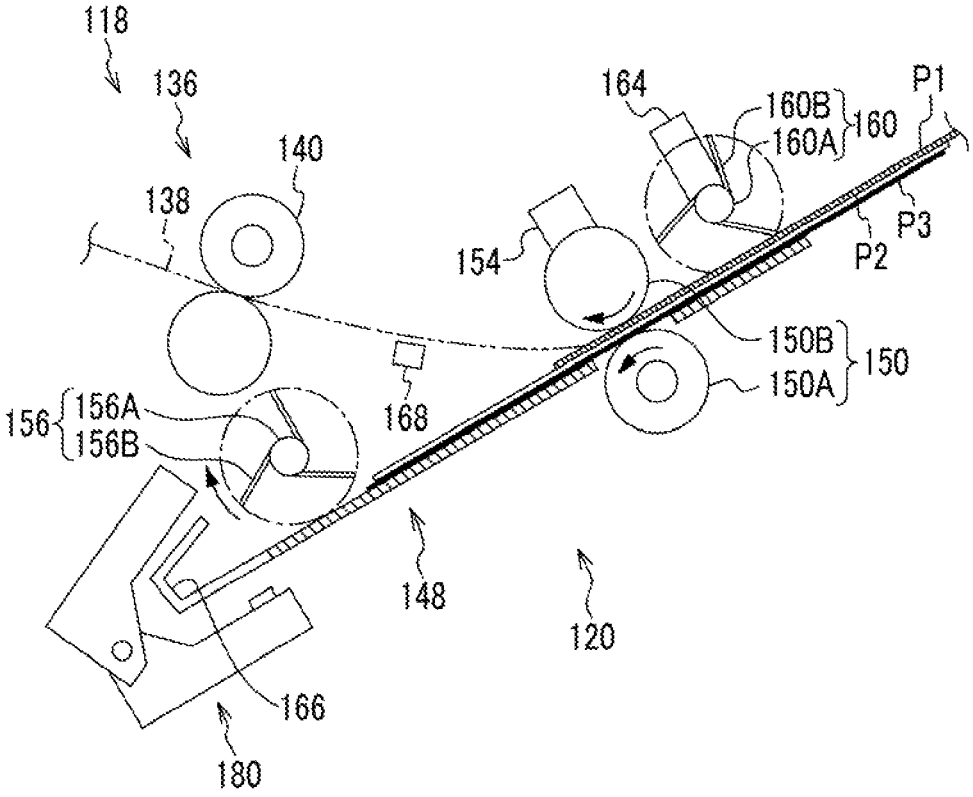
FIGS. 1A and 1B are side views showing a stack table or the like provided in a post-processor according to an exemplary embodiment of the invention.
Figure 1B:
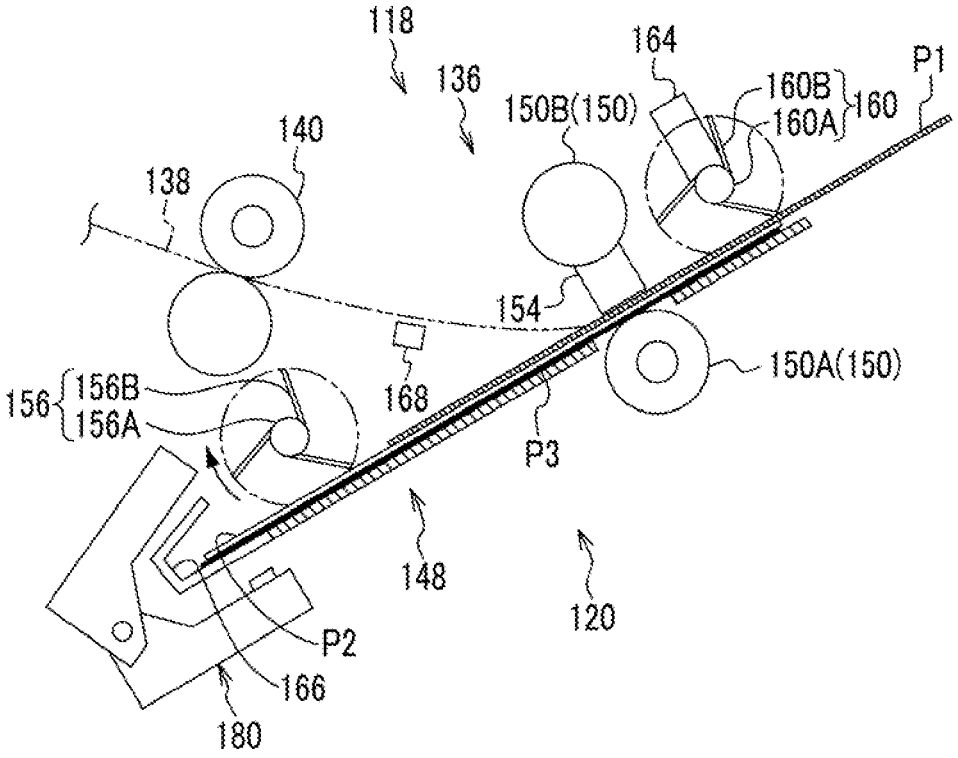

The butting roller 150 that rotates in the reverse direction and the second paddle 160 that rotates, as shown in FIG. 1A, transports the three sheet members P so that edge portions (trailing edge portions) of the three sheet members P butt against the aligning portion 166.

Then, before the edge portion of the lowermost sheet member P3 butts against the aligning portion 166, the controller 124, as shown in FIG. 18, controls the roller vertically-moving mechanisms 154 to move the driven roller 150B from the contact position to the spaced position. Then, the edge portion of the lowermost sheet member P3 butts against the aligning portion 166 with the momentum of a transport force transmitted from the butting roller 150.

Additionally, when the driven roller 150B moves from the contact position to the spaced position, the first paddle 156 that rotates is set to contact with the lower sheet member P2 to press the edge portion of the lower sheet member P2 against the aligning portion 166 (the driven roller 150B moves from the contact position to the spaced position before the edge portion of the lower sheet member P2 butts against the aligning portion 166). Then, the first paddle 156 that rotates, as shown in FIG. 2A, presses the edge portion of the lower sheet member P2 against the aligning portion 166.

Here, as mentioned above, the lower sheet member P2 and the uppermost sheet member P1 are shifted and superimposed in the sheet transport direction so that, after the first paddle 156 presses the lower sheet member P2 against the aligning portion 166, the uppermost sheet member P1 transported by the second paddle 160 and the first paddle 156 contact with each other and the first paddle 156 presses the uppermost sheet member P1 against the aligning portion 166.

Figure 2B:
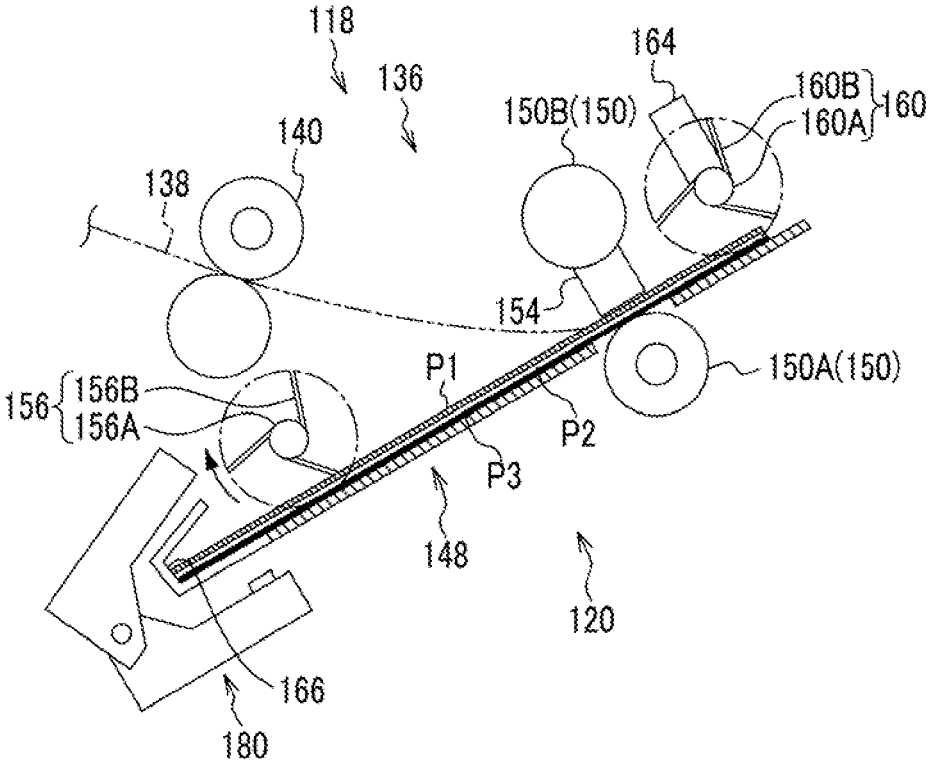

For this reason, after the first paddle 156 presses the lower sheet member P2 against the aligning portion 166, the uppermost sheet member P1 transported by the second paddle 160, as shown in FIG. 2A and FIG. 2B, contacts with the first paddle 156 that rotates. Then, the first paddle 156 that rotates presses the edge portion of the uppermost sheet member P1 against the aligning portion 166. Accordingly, the sheet transport directions of the three sheet members P are aligned.

In this state, the controller 124, as shown in FIG. 3A, controls the stapling mechanism 180 to staple and bind the three sheet members P. Moreover, the controller 124 controls the roller vertically-moving mechanisms 154 to move the driven roller 150B from the spaced position to the contact position, and controls the paddle vertically-moving mechanism 164 to move the second paddle 160 from the contact position to the spaced position. Additionally, the controller 124 controls the motor 158 to stop the rotation of the first paddle 156.

Figure 3B:
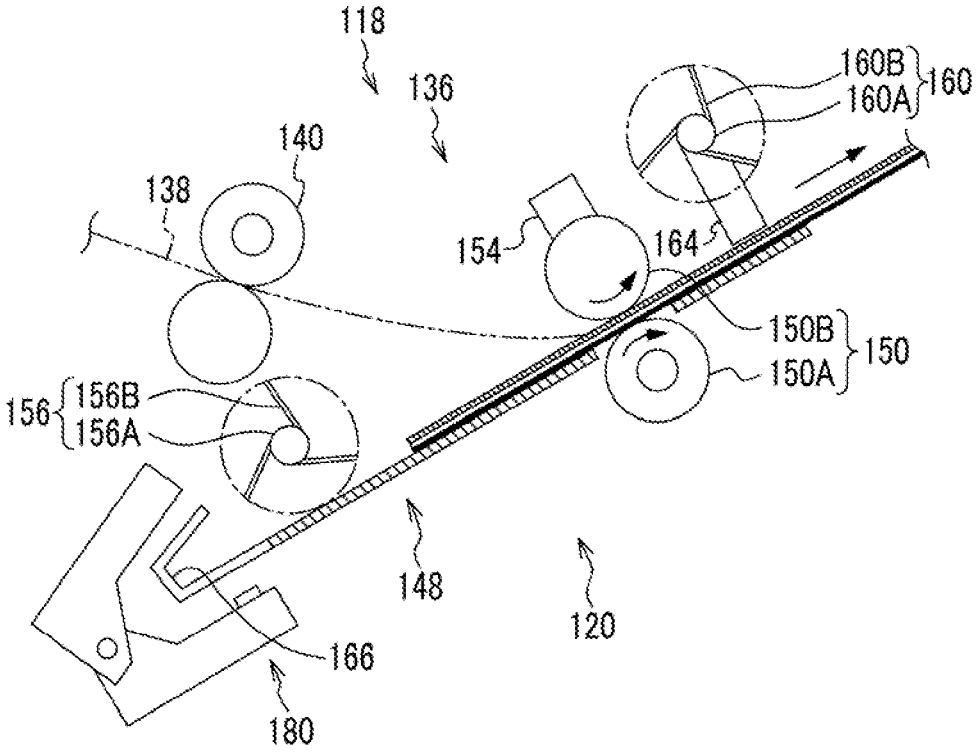

Moreover, the controller 124, as shown in FIG. 3B, controls the motor 152 to rotate the butting roller 150 in the normal direction. The butting roller 150 that rotates in the normal direction ejects the three stapled and bound sheet members P to the ejection table 170 through the ejection port 122B (refer to FIG. 11).

In addition, although the blade portions 156B of the first paddle 156 and the uppermost sheet member P1 contact with each other, since a transport force transmitted from the butting roller 150 to the sheet member P is greater than a frictional force between the blade portions 156B and the uppermost sheet member P1, ejection of the sheet member P is not hindered.

CONCLUSION

As mentioned above, the lower sheet member P2 and the uppermost sheet member P1 are shifted and superimposed by the buffer portion 136 so that the first paddle 156 presses the edge portion of the lower sheet member P2 against the aligning portion 166, and then presses the edge portion of the uppermost sheet member P1 against the aligning portion 166. That is, when the first paddle 156 presses the edge portion of the lower sheet member P2 against the aligning portion 166, the first paddle 156 and the lower sheet member P2 contact with each other. For this reason, rebounding of the lower sheet member P2 in the reverse direction by the momentum caused by the butting of the lower sheet member P2 against the aligning portion 166 is suppressed by a frictional force between the lower sheet member and the blade portions 156B of the first paddle 156. In addition, rebounding of the uppermost sheet member P1 is suppressed by a frictional force between the uppermost sheet member and the blade portions 156B of the first paddle 156, and rebounding of the lowermost sheet member P3 is suppressed by a frictional force between the lowermost sheet member and the stacking surface 148A.

As the rebounding of the three sheet members P is suppressed, the edge portions (trailing edge portions) of the three sheet members P superimposed on the stack table 148 are aligned.

Additionally, in the buffer portion 136, the sheet member P that is previously transported is retreated to the retreat path 141, and the sheet member P that is transported next, and the sheet member P that is retreated to the retreat path 141 and transported from the retreat path 141 toward the transporting path 138 are shifted and superimposed. In this way, the sheet members P to be transported are shifted and superimposed with a simple configuration.

In addition, although the specific embodiment of the invention has been described in detail, it is apparent to those skilled in the art that the invention is not limited to the relevant embodiment and other various exemplary embodiments may be taken within the scope of the invention. For example, although there is no particular description in the aforementioned exemplary embodiment, in the first paddle 156 and the second paddle 160, the blade portions may be split into plural pieces in the axial direction.

Additionally, although the aforementioned exemplary embodiment has been described taking a case where the three sheet members P are superimposed as an example, a case where four or more sheet members P are superimposed may be adopted. Also in this case, the rebounding of the lower sheet member P2 caused by the butting of the lower sheet member P2 against the aligning portion 166 is suppressed.

Additionally, in the aforementioned exemplary embodiment, the upper roller of the butting roller 150 is a driven roller. However, this roller may be driven when the sheet member P is ejected to the ejection table 170.

Additionally, although there is no particular description in the aforementioned exemplary embodiment, the post-processor 110 may be dealt with as an option of an image forming apparatus, and only the post-processor 110 may be distributed on the market.

Additionally, in the aforementioned exemplary embodiment, the uppermost sheet member P1 is pressed against the aligning portion 166 by the first paddle 156. However, the uppermost sheet member P1 may be pressed against the aligning portion 166 by the second paddle 160.

Additionally, in the aforementioned exemplary embodiment, the first paddle 156 and the second paddle 160 are moved by the separate motors. However, driving may be coupled together, may be controlled by a clutch, and may be moved by the same motor.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A processing device comprising:

a shifting member that superimposes recording media during transportation and that places an uppermost recording medium and a lower recording medium on the lower side of the uppermost recording medium in a plurality of superimposed recording media, on a stack table on which the recording media are stacked, in a state where the uppermost recording medium and the lower recording medium are shifted in a transport direction of the recording media;

a butting member that transports the recording media placed on the stack table so that edge portions of the plurality of recording media superimposed in a state where the uppermost recording medium and the lower recording medium are shifted to butt against an aligning member arranged on an upstream side in the transport direction of the recording media with respect to the stack table;

a first pressing member that is arranged above the stack table and that contacts with the lower recording medium among the plurality of recording media transported by the butting member to press the edge portion of the lower recording medium against the aligning member, and then contacts with the uppermost recording medium to press the edge portion of the uppermost recording medium against the aligning member; and a second pressing member arranged on the opposite side of the first pressing member across the butting member, wherein a controller controls such that the shifting member retreats the recording medium transported along a transporting path for the recording media to a retreat path to which the recording medium is retreated from the transporting path, and superimposes and transports a recording medium that is next transported along the transporting path, and a recording medium that is retreated to the retreat path and transported from the retreat path toward the transporting path, and wherein the controller controls such that the shifting member shifts the lower recording medium and the uppermost recording medium in the transport direction so that, when the uppermost recording medium is superimposed on the lower recording medium, the first pressing member contacts with the lower recording medium to press the edge portion of the lower recording medium against the aligning member, and then the first pressing member contacts with the uppermost recording medium to press the edge portion of the uppermost recording medium against the aligning member.

2. An image forming apparatus comprising:

an image forming main body that forms an image on a recording medium; and the processing device according to claim 1 that processes the recording medium on which the image is formed by the image forming main body.

* * * * *